US007678425B2

(12) United States Patent
Oldorff

(10) Patent No.: US 7,678,425 B2
(45) Date of Patent: Mar. 16, 2010

(54) PROCESS FOR FINISHING A WOODEN BOARD AND WOODEN BOARD PRODUCED BY THE PROCESS

(75) Inventor: Frank Oldorff, Schwerin (DE)

(73) Assignee: Flooring Technologies Ltd., Pieta (MT)

( * ) Notice: Subject to any disclaimer, the term of this patent is extended or adjusted under 35 U.S.C. 154(b) by 1313 days.

(21) Appl. No.: 10/792,270

(22) Filed: Mar. 4, 2004

(65) Prior Publication Data

US 2004/0191547 A1 Sep. 30, 2004

(30) Foreign Application Priority Data

Mar. 6, 2003 (DE) ..... 103 10 199
Sep. 6, 2003 (EP) ..... 03020230

(51) Int. Cl.
*B32B 5/66* (2006.01)

(52) U.S. Cl. ..... 427/384; 427/393; 427/408; 427/372.2; 428/195; 428/537.1

(58) Field of Classification Search ..... 427/383, 427/384, 393, 372.2, 408; 428/537.1, 195
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Milte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |

(Continued)

FOREIGN PATENT DOCUMENTS

| | | |
|---|---|---|
| AT | 005566 | 8/2002 |

(Continued)

OTHER PUBLICATIONS

European Search Report for counterpart application serial No. EP 03 02 0230.

(Continued)

*Primary Examiner*—Leszek Kiliman
(74) *Attorney, Agent, or Firm*—Greenblum & Bernstein, P.L.C.

(57) ABSTRACT

A process for finishing a wood or wooden board, in particular an MDF or HDF board, with an upper side and an underside. The process includes applying a sealing layer of melamine resin to the upper side of the board and printing a decoration onto the sealing layer. A protective layer is applied of melamine resin to the decoration and the board is pressed under the action of temperature until the protective layer and the sealing layer melt and bond to each other with the inclusion of the decoration printed on.

19 Claims, 1 Drawing Sheet

U.S. PATENT DOCUMENTS

| | | | | |
|---|---|---|---|---|
| 3,100,556 | A | | 8/1963 | De Ridder |
| 3,125,138 | A | | 3/1964 | Bolenbach |
| 3,173,804 | A | | 3/1965 | Standfuss |
| 3,182,769 | A | | 5/1965 | De Ridder |
| 3,203,149 | A | | 8/1965 | Soddy |
| 3,204,380 | A | | 9/1965 | Smith et al. |
| 3,267,630 | A | | 8/1966 | Omholt |
| 3,282,010 | A | | 11/1966 | King, Jr. |
| 3,286,006 | A | | 11/1966 | Annand |
| 3,310,919 | A | | 3/1967 | Bue et al. |
| 3,347,048 | A | | 10/1967 | Brown et al. |
| 3,460,304 | A | | 8/1969 | Braeuninger et al. |
| 3,481,810 | A | | 12/1969 | Waite |
| 3,526,420 | A | | 9/1970 | Brancaleone |
| 3,538,665 | A | | 11/1970 | Gohner |
| 3,553,919 | A | | 1/1971 | Omholt |
| 3,555,762 | A | | 1/1971 | Costanzo, Jr. |
| 3,608,258 | A | | 9/1971 | Spratt |
| 3,694,983 | A | | 10/1972 | Couquet |
| 3,714,747 | A | | 2/1973 | Curran |
| 3,720,027 | A | | 3/1973 | Christensen |
| 3,731,445 | A | | 5/1973 | Hoffmann et al. |
| 3,759,007 | A | | 9/1973 | Thiele |
| 3,760,548 | A | | 9/1973 | Sauer et al. |
| 3,768,846 | A | | 10/1973 | Hensley et al. |
| 3,811,915 | A | | 5/1974 | Burrell et al. |
| 3,853,578 | A | | 12/1974 | Suzuki et al. |
| 3,859,000 | A | | 1/1975 | Webster |
| 3,878,030 | A | | 4/1975 | Cook |
| 3,902,293 | A | | 9/1975 | Witt et al. |
| 3,908,053 | A | | 9/1975 | Hettich |
| 3,912,569 | A | | 10/1975 | Kapral |
| 3,936,551 | A | | 2/1976 | Elmendorf et al. |
| 3,988,187 | A | | 10/1976 | Witt et al. |
| 4,006,048 | A | | 2/1977 | Cannady, Jr. et al. |
| 4,090,338 | A | | 5/1978 | Bourgade |
| 4,091,136 | A | | 5/1978 | O'Brian et al. |
| 4,099,358 | A | | 7/1978 | Compaan |
| 4,118,533 | A | | 10/1978 | Hipchen et al. |
| 4,131,705 | A | | 12/1978 | Kubinsky |
| 4,164,832 | A | | 8/1979 | Van Zandt |
| 4,169,688 | A | | 10/1979 | Toshio |
| 4,242,390 | A | | 12/1980 | Nemeth |
| 4,243,716 | A | | 1/1981 | Kosaka et al. |
| 4,245,689 | A | | 1/1981 | Grard et al. |
| 4,246,310 | A | | 1/1981 | Hunt et al. |
| 4,290,248 | A | | 9/1981 | Kemerer et al. |
| 4,299,070 | A | | 11/1981 | Oltmanns et al. |
| 4,426,820 | A | | 1/1984 | Terbrack et al. |
| 4,431,044 | A | | 2/1984 | Bruneau |
| 4,471,012 | A | | 9/1984 | Maxwell |
| 4,501,102 | A | | 2/1985 | Knowles |
| 4,520,062 | A | | 5/1985 | Ungar et al. |
| 4,561,233 | A | | 12/1985 | Harter et al. |
| 4,585,685 | A | | 4/1986 | Forry et al. |
| 4,612,745 | A | | 9/1986 | Hovde |
| 4,641,469 | A | | 2/1987 | Wood |
| 4,653,242 | A | | 3/1987 | Ezard |
| 4,654,244 | A | | 3/1987 | Eckert et al. |
| 4,703,597 | A | | 11/1987 | Eggemar |
| 4,715,162 | A | | 12/1987 | Brightwell |
| 4,738,071 | A | | 4/1988 | Ezard |
| 4,752,497 | A | | 6/1988 | McConkey et al. |
| 4,756,951 | A | | 7/1988 | Wang et al. |
| 4,769,963 | A | | 9/1988 | Meyerson |
| 4,819,932 | A | | 4/1989 | Trotter, Jr. |
| 4,831,806 | A | | 5/1989 | Niese et al. |
| 4,845,907 | A | | 7/1989 | Meek |
| 4,849,768 | A | | 7/1989 | Graham |
| 4,856,857 | A | * | 8/1989 | Takeuchi et al. ..... 359/3 |
| 4,890,656 | A | * | 1/1990 | Ohsumi et al. ..... 144/350 |
| 4,905,442 | A | | 3/1990 | Daniels |
| 4,947,602 | A | | 8/1990 | Pollasky |
| 5,029,425 | A | | 7/1991 | Bogataj |
| 5,103,614 | A | | 4/1992 | Kawaguchi et al. |
| 5,113,632 | A | | 5/1992 | Hanson |
| 5,117,603 | A | | 6/1992 | Weintraub |
| 5,136,823 | A | | 8/1992 | Pellegrino |
| 5,165,816 | A | | 11/1992 | Parasin |
| 5,179,812 | A | | 1/1993 | Hill |
| 5,205,091 | A | | 4/1993 | Brown |
| 5,216,861 | A | | 6/1993 | Meyerson |
| 5,251,996 | A | | 10/1993 | Hiller et al. |
| 5,253,464 | A | | 10/1993 | Nilsen |
| 5,283,102 | A | | 2/1994 | Sweet et al. |
| 5,295,341 | A | | 3/1994 | Kajiwara |
| 5,335,473 | A | | 8/1994 | Chase |
| 5,348,778 | A | | 9/1994 | Knipp et al. |
| 5,349,796 | A | | 9/1994 | Meyerson |
| 5,390,457 | A | | 2/1995 | Sjölander |
| 5,413,834 | A | | 5/1995 | Hunter et al. |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,567,497 | A | | 10/1996 | Zegler et al. |
| 5,570,554 | A | | 11/1996 | Searer |
| 5,597,024 | A | | 1/1997 | Bolyard et al. |
| 5,629,259 | A | * | 5/1997 | Akada et al. ..... 503/227 |
| 5,630,304 | A | | 5/1997 | Austin |
| 5,653,099 | A | | 8/1997 | MacKenzie |
| 5,671,575 | A | | 9/1997 | Wu |
| 5,694,734 | A | | 12/1997 | Cercone et al. |
| 5,706,621 | A | | 1/1998 | Pervan |
| 5,736,227 | A | | 4/1998 | Sweet et al. |
| 5,768,850 | A | | 6/1998 | Chen |
| 5,797,175 | A | | 8/1998 | Schneider |
| 5,797,237 | A | | 8/1998 | Finkell, Jr. |
| 5,823,240 | A | | 10/1998 | Bolyard et al. |
| 5,827,592 | A | | 10/1998 | Van Gulik et al. |
| 5,830,548 | A | * | 11/1998 | Andersen et al. ..... 428/36.4 |
| 5,860,267 | A | | 1/1999 | Pervan |
| 5,935,668 | A | | 8/1999 | Smith |
| 5,943,239 | A | | 8/1999 | Shamblin et al. |
| 5,953,878 | A | | 9/1999 | Johnson |
| 5,968,625 | A | | 10/1999 | Hudson |
| 5,985,397 | A | | 11/1999 | Witt et al. |
| 5,987,839 | A | | 11/1999 | Hamar et al. |
| 6,006,486 | A | | 12/1999 | Moriau et al. |
| 6,023,907 | A | | 2/2000 | Pervan |
| 6,065,262 | A | | 5/2000 | Motta |
| 6,094,882 | A | | 8/2000 | Pervan |
| 6,101,778 | A | | 8/2000 | Martensson |
| 6,119,423 | A | | 9/2000 | Costantino |
| 6,134,854 | A | | 10/2000 | Stanchfield |
| 6,148,884 | A | | 11/2000 | Bolyard et al. |
| 6,168,866 | B1 | | 1/2001 | Clark |
| 6,182,410 | B1 | | 2/2001 | Pervan |
| 6,186,703 | B1 | | 2/2001 | Shaw |
| 6,205,639 | B1 | | 3/2001 | Pervan |
| 6,209,278 | B1 | | 4/2001 | Tychsen |
| 6,216,403 | B1 | | 4/2001 | Belbeoc'h |
| 6,216,409 | B1 | | 4/2001 | Roy et al. |
| D442,296 | S | | 5/2001 | Külik |
| D442,297 | S | | 5/2001 | Külik |
| D442,298 | S | | 5/2001 | Külik |
| D442,706 | S | | 5/2001 | Külik |
| D442,707 | S | | 5/2001 | Külik |
| 6,224,698 | B1 | | 5/2001 | Endo |
| 6,238,798 | B1 | | 5/2001 | Kang et al. |
| 6,247,285 | B1 | | 6/2001 | Moebus |
| D449,119 | S | | 10/2001 | Külik |
| D449,391 | S | | 10/2001 | Külik |

| | | | | |
|---|---|---|---|---|
| D449,392 | S | 10/2001 | Külik | |
| 6,324,803 | B1 | 12/2001 | Pervan | |
| 6,345,481 | B1 | 2/2002 | Nelson | |
| 6,363,677 | B1 | 4/2002 | Chen et al. | |
| 6,397,547 | B1 | 6/2002 | Martensson | |
| 6,413,364 | B1 * | 7/2002 | Sandison | 162/4 |
| 6,418,683 | B1 | 7/2002 | Martensson et al. | |
| 6,421,970 | B1 | 7/2002 | Martensson et al. | |
| 6,427,408 | B1 | 8/2002 | Krieger | |
| 6,436,159 | B1 | 8/2002 | Safta et al. | |
| 6,438,919 | B1 | 8/2002 | Knauseder | |
| 6,446,405 | B1 | 9/2002 | Pervan | |
| 6,449,913 | B1 | 9/2002 | Shelton | |
| 6,449,918 | B1 | 9/2002 | Nelson | |
| 6,453,632 | B1 | 9/2002 | Huang | |
| 6,458,232 | B1 | 10/2002 | Valentinsson | |
| 6,460,306 | B1 | 10/2002 | Nelson | |
| 6,461,636 | B1 | 10/2002 | Arth et al. | |
| 6,465,046 | B1 | 10/2002 | Hansson et al. | |
| 6,490,836 | B1 | 12/2002 | Moriau et al. | |
| 6,497,961 | B2 | 12/2002 | Kang et al. | |
| 6,510,665 | B2 | 1/2003 | Pervan | |
| 6,516,579 | B1 | 2/2003 | Pervan | |
| 6,517,935 | B1 | 2/2003 | Kornfalt et al. | |
| 6,519,912 | B1 | 2/2003 | Eckmann et al. | |
| 6,521,314 | B2 | 2/2003 | Tychsen | |
| 6,532,709 | B2 | 3/2003 | Pervan | |
| 6,533,855 | B1 | 3/2003 | Gaynor et al. | |
| 6,536,178 | B1 | 3/2003 | Pervan et al. | |
| 6,546,691 | B2 | 4/2003 | Peopolder | |
| 6,551,702 | B1 * | 4/2003 | Biedermann et al. | 428/323 |
| 6,553,724 | B1 | 4/2003 | Bigler | |
| 6,558,754 | B1 | 5/2003 | Velin et al. | |
| 6,565,919 | B1 | 5/2003 | Hansson et al. | |
| 6,568,148 | B1 | 5/2003 | Eisermann | |
| 6,569,272 | B2 | 5/2003 | Tychsen | |
| 6,588,166 | B2 | 7/2003 | Martensson et al. | |
| 6,591,568 | B1 | 7/2003 | Palsson | |
| 6,601,359 | B2 | 8/2003 | Olofsson | |
| 6,606,834 | B2 | 8/2003 | Martensson et al. | |
| 6,617,009 | B1 | 9/2003 | Chen et al. | |
| 6,635,174 | B1 | 10/2003 | Berg et al. | |
| 6,641,629 | B2 | 11/2003 | Safta et al. | |
| 6,646,088 | B2 | 11/2003 | Fan et al. | |
| 6,647,690 | B1 | 11/2003 | Martensson | |
| 6,649,687 | B1 | 11/2003 | Gheewala et al. | |
| 6,659,097 | B1 | 12/2003 | Houston | |
| 6,672,030 | B2 | 1/2004 | Schulte | |
| 6,675,545 | B2 | 1/2004 | Chen et al. | |
| 6,681,820 | B2 | 1/2004 | Olofsson | |
| 6,682,254 | B1 | 1/2004 | Olofsson et al. | |
| 6,685,993 | B1 | 2/2004 | Hansson et al. | |
| 6,711,864 | B2 | 3/2004 | Erwin | |
| 6,711,869 | B2 | 3/2004 | Tychsen | |
| 6,715,253 | B2 | 4/2004 | Pervan | |
| 6,723,438 | B2 | 4/2004 | Chang et al. | |
| 6,729,091 | B1 | 5/2004 | Martensson | |
| 6,745,534 | B2 | 6/2004 | Kornfalt | |
| 6,761,008 | B2 | 7/2004 | Chen et al. | |
| 6,761,794 | B2 | 7/2004 | Mott et al. | |
| 6,763,643 | B1 | 7/2004 | Martensson | |
| 6,766,622 | B1 | 7/2004 | Thiers | |
| 6,769,217 | B2 | 8/2004 | Nelson | |
| 6,769,218 | B2 | 8/2004 | Pervan | |
| 6,769,835 | B2 | 8/2004 | Stridsman | |
| 6,772,568 | B2 | 8/2004 | Thiers et al. | |
| 6,786,019 | B2 | 9/2004 | Thiers | |
| 6,803,109 | B2 | 10/2004 | Qiu et al. | |
| 6,805,951 | B2 | 10/2004 | Kornfält et al. | |
| 6,823,638 | B2 | 11/2004 | Stanchfield | |
| 6,841,023 | B2 | 1/2005 | Mott | |
| 7,137,229 | B2 * | 11/2006 | Pervan | 52/313 |
| 7,171,998 | B2 * | 2/2007 | Vogel | 144/358 |
| 2001/0010839 | A1 | 8/2001 | Martino | |
| 2001/0029720 | A1 | 10/2001 | Pervan | |
| 2001/0034992 | A1 | 11/2001 | Pletzer et al. | |
| 2002/0007608 | A1 | 1/2002 | Pervan | |
| 2002/0007609 | A1 | 1/2002 | Pervan | |
| 2002/0014047 | A1 | 2/2002 | Thiers | |
| 2002/0020127 | A1 | 2/2002 | Thiers et al. | |
| 2002/0046528 | A1 | 4/2002 | Pervan et al. | |
| 2002/0056245 | A1 | 5/2002 | Thiers | |
| 2002/0106439 | A1 | 8/2002 | Cappelle | |
| 2003/0024200 | A1 | 2/2003 | Moriau et al. | |
| 2003/0024201 | A1 | 2/2003 | Moriau et al. | |
| 2003/0029115 | A1 | 2/2003 | Moriau et al. | |
| 2003/0029116 | A1 | 2/2003 | Moriau et al. | |
| 2003/0029117 | A1 | 2/2003 | Moriau et al. | |
| 2003/0033777 | A1 | 2/2003 | Thiers et al. | |
| 2003/0033784 | A1 | 2/2003 | Pervan | |
| 2003/0115812 | A1 | 6/2003 | Pervan | |
| 2003/0115821 | A1 | 6/2003 | Pervan | |
| 2003/0159385 | A1 | 8/2003 | Thiers | |
| 2003/0167717 | A1 | 9/2003 | Garcia | |
| 2003/0196405 | A1 | 10/2003 | Pervan | |
| 2003/0205013 | A1 | 11/2003 | Garcia | |
| 2003/0233809 | A1 | 12/2003 | Pervan | |
| 2004/0016196 | A1 | 1/2004 | Pervan | |
| 2004/0035078 | A1 | 2/2004 | Pervan | |
| 2004/0092006 | A1 | 5/2004 | Lindekens et al. | |
| 2004/0105994 | A1 | 6/2004 | Lu et al. | |
| 2004/0139678 | A1 | 7/2004 | Pervan | |
| 2004/0159066 | A1 | 8/2004 | Thiers et al. | |
| 2004/0177584 | A1 | 9/2004 | Pervan | |
| 2004/0200165 | A1 | 10/2004 | Garcia et al. | |
| 2004/0206036 | A1 | 10/2004 | Pervan | |
| 2004/0237447 | A1 | 12/2004 | Thiers et al. | |
| 2004/0237448 | A1 | 12/2004 | Thiers et al. | |
| 2004/0241374 | A1 | 12/2004 | Thiers et al. | |
| 2004/0244322 | A1 | 12/2004 | Thiers et al. | |
| 2004/0250493 | A1 | 12/2004 | Thiers et al. | |
| 2004/0255541 | A1 | 12/2004 | Thiers et al. | |
| 2004/0258907 | A1 | 12/2004 | Kornfalt et al. | |
| 2005/0003149 | A1 | 1/2005 | Kornfalt et al. | |
| 2005/0016099 | A1 | 1/2005 | Thiers | |
| 2005/0089644 | A1 * | 4/2005 | Oldorff | 427/393 |

FOREIGN PATENT DOCUMENTS

| | | |
|---|---|---|
| AU | 713628 | 5/1998 |
| AU | 200020703 | 1/2000 |
| BE | 417526 | 9/1936 |
| BE | 557844 | 6/1957 |
| BE | 557844 | 3/1960 |
| BE | 09600527 | 6/1998 |
| BE | 09700344 | 10/1998 |
| CA | 991373 | 6/1976 |
| CA | 2226286 | 12/1997 |
| CA | 2252791 | 5/1999 |
| CA | 2289309 | 7/2000 |
| CH | 200949 | 1/1939 |
| CH | 211877 | 1/1941 |
| CH | 562377 | 5/1975 |
| DE | 314207 | 9/1919 |
| DE | 531989 | 8/1931 |
| DE | 740235 | 10/1943 |
| DE | 1089966 | 9/1960 |
| DE | 1212225 | 3/1966 |
| DE | 1212275 | 3/1966 |
| DE | 1534802 | 4/1970 |
| DE | 7102476 | 6/1971 |
| DE | 2007129 | 9/1971 |
| DE | 1534278 | 11/1971 |
| DE | 2252643 | 10/1972 |
| DE | 2238660 | 2/1974 |
| DE | 7402354 | 5/1974 |

| | | | |
|---|---|---|---|
| DE | 24 54 343 | A | 5/1976 |
| DE | 2502992 | | 7/1976 |
| DE | 2616077 | | 10/1977 |
| DE | 2917025 | | 11/1980 |
| DE | 7911924 | | 3/1981 |
| DE | 7928703 | | 5/1981 |
| DE | 3041781 | | 6/1982 |
| DE | 3214207 | | 11/1982 |
| DE | 8226153 | | 1/1983 |
| DE | 3343601 | | 6/1985 |
| DE | 86040049 | | 6/1986 |
| DE | 3512204 | | 10/1986 |
| DE | 3246376 | | 2/1987 |
| DE | 4004891 | | 9/1990 |
| DE | 4002547 | | 8/1991 |
| DE | 4134452 | | 4/1993 |
| DE | 4215273 | | 11/1993 |
| DE | 4242530 | | 6/1994 |
| DE | 43 04 491 | | 8/1994 |
| DE | 4011656 | | 1/1995 |
| DE | 4324137 | | 1/1995 |
| DE | 4107151 | | 2/1995 |
| DE | 29517128 | | 2/1996 |
| DE | 3544845 | | 12/1996 |
| DE | 195 29 987 | | 2/1997 |
| DE | 195 32 819 | A1 | 3/1997 |
| DE | 29710175 | | 9/1997 |
| DE | 19616510 | | 3/1998 |
| DE | 19651149 | | 6/1998 |
| DE | 19709641 | | 9/1998 |
| DE | 19718319 | | 11/1998 |
| DE | 197 51 115 | A | 5/1999 |
| DE | 19735189 | | 6/2000 |
| DE | 199 03 913 | A1 | 8/2000 |
| DE | 20001225 | | 8/2000 |
| DE | 19925248 | | 12/2000 |
| DE | 199 41 300 | A | 3/2001 |
| DE | 20017461 | | 3/2001 |
| DE | 20018284 | | 3/2001 |
| DE | 100 12 136 | A | 9/2001 |
| DE | 100 19 054 | C1 | 12/2001 |
| DE | 20206460 | | 8/2002 |
| DE | 101 17 807 | | 10/2002 |
| DE | 20218331 | | 5/2004 |
| EP | 0248127 | | 12/1987 |
| EP | 0 574 953 | A | 12/1993 |
| EP | 0623724 | | 11/1994 |
| EP | 0652340 | | 5/1995 |
| EP | 0667936 | | 8/1995 |
| EP | 0690185 | | 1/1996 |
| EP | 0849416 | | 6/1998 |
| EP | 0698162 | | 9/1998 |
| EP | 0903451 | | 3/1999 |
| EP | 0855482 | | 12/1999 |
| EP | 0877130 | | 1/2000 |
| EP | 0969163 | | 1/2000 |
| EP | 0969164 | | 1/2000 |
| EP | 0974713 | | 1/2000 |
| EP | 1 026 008 | A | 8/2000 |
| EP | 0843763 | | 10/2000 |
| EP | 1200690 | | 5/2002 |
| EP | 0958441 | | 7/2003 |
| EP | 1026341 | | 8/2003 |
| ES | 163421 | | 9/1968 |
| ES | 460194 | | 5/1978 |
| ES | 283331 | | 5/1985 |
| ES | 1019585 | | 4/1992 |
| ES | 2168045 | | 5/2002 |
| FI | 843060 | | 8/1984 |
| FR | 1293043 | | 4/1962 |
| FR | 2568295 | | 5/1986 |
| FR | 2623544 | | 5/1989 |
| FR | 2630149 | | 10/1989 |
| FR | 2637932 | | 4/1990 |
| FR | 2675174 | | 10/1991 |
| FR | 2667639 | | 4/1992 |
| FR | 2691491 | | 11/1993 |
| FR | 2697275 | | 4/1994 |
| FR | 2712329 | | 5/1995 |
| FR | 2776956 | | 10/1999 |
| FR | 2781513 | | 1/2000 |
| FR | 2785633 | | 5/2000 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1033866 | | 6/1966 |
| GB | 1034117 | | 6/1966 |
| GB | 1044846 | | 10/1966 |
| GB | 1237744 | | 6/1968 |
| GB | 1127915 | | 9/1968 |
| GB | 1275511 | | 5/1972 |
| GB | 1399402 | | 7/1975 |
| GB | 1430423 | | 3/1976 |
| GB | 2117813 | | 10/1983 |
| GB | 2126106 | | 3/1984 |
| GB | 2152063 | | 7/1985 |
| GB | 2238660 | | 6/1991 |
| GB | 2243381 | | 10/1991 |
| GB | 2256023 | | 11/1992 |
| JP | 54-65528 | | 5/1979 |
| JP | 57-119056 | | 7/1982 |
| JP | 59-186336 | | 10/1984 |
| JP | 3-169967 | | 7/1991 |
| JP | 4-106264 | | 4/1992 |
| JP | 5-148984 | | 6/1993 |
| JP | 6-56310 | | 5/1994 |
| JP | 6-146553 | | 5/1994 |
| JP | 6-200611 | | 7/1994 |
| JP | 6-320510 | | 11/1994 |
| JP | 7-76923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 8-270193 | | 10/1996 |
| NE | 7601773 | | 2/1976 |
| NO | 157871 | | 2/1988 |
| NO | 305614 | | 6/1999 |
| SE | 7114900-9 | | 9/1974 |
| SE | 450411 | | 6/1987 |
| SE | 450141 | | 9/1987 |
| SE | 501014 | | 10/1994 |
| SE | 501914 | | 6/1995 |
| SE | 502994 | | 4/1996 |
| SE | 506254 | | 11/1997 |
| SE | 509059 | | 11/1998 |
| SE | 509060 | | 11/1998 |
| SE | 512290 | | 2/2000 |
| SE | 512313 | | 2/2000 |
| SE | 0000200-6 | | 8/2001 |
| SU | 363795 | | 12/1972 |
| WO | 84/02155 | | 6/1984 |
| WO | 87/03839 | | 7/1987 |
| WO | 89/08539 | | 9/1989 |
| WO | 92/17657 | | 10/1992 |
| WO | 93/13280 | | 7/1993 |
| WO | 93/19910 | | 10/1993 |
| WO | 94/01628 | | 1/1994 |
| WO | 94/26999 | | 11/1994 |
| WO | 9426999 | | 11/1994 |
| WO | 95/06176 | | 3/1995 |
| WO | 96/27719 | | 9/1996 |
| WO | 96/27721 | | 9/1996 |
| WO | 96/30177 | | 10/1996 |

| | | |
|---|---|---|
| WO | 97/47834 | 12/1997 |
| WO | 98/24495 | 6/1998 |
| WO | 98/24994 | 6/1998 |
| WO | 98/38401 | 9/1998 |
| WO | 9940273 | 8/1999 |
| WO | 99/66151 | 12/1999 |
| WO | 9966152 | 12/1999 |
| WO | 0006854 | 2/2000 |
| WO | 0066856 | 11/2000 |
| WO | WO 01/48333 | 7/2001 |
| WO | 0166876 | 9/2001 |

OTHER PUBLICATIONS

Webster Dictionary, p. 862.

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

PROCESS FOR FINISHING A WOODEN BOARD AND WOODEN BOARD PRODUCED BY THE PROCESS

BACKGROUND OF THE INVENTION

1. Field of the Invention

The invention generally relates to a wooden board and a process for finishing a wooden board, in particular an MDF or HDF board with an upper side and an underside. These boards may be used, for example, for furniture construction and panels, in particular flooring panels.

2. Background Description

Flooring panels with a substrate board made of wood are normally designated laminate panels and have been on the market for many years to substitute for parquet. The desired decoration (parquet, wood grain, tiles, and so on) is printed onto a paper web, which is subsequently coated with resin and rolled up on a roll or stacked as sheet goods. The decorative web prefabricated in this way is laid on the substrate board at the flooring manufacturer and is pressed.

As a result of printing the decoration onto the paper web, the later sealing of the paper web with synthetic resin and the subsequent connection of the decorative layer to the substrate board by means of pressure and temperature, the dimensions of the paper web are changed. Those skilled in the commonly refer to this phenomenon as paper growing. The paper grows both in length (lengthwise growth) and also in width (widthwise growth).

If this decorative board is then to be cut to size to form individual panels, the lengthwise and widthwise growth must be taken into account, since otherwise there would be an unequal distribution of the decoration on the individual panels. This would result in the floor assembled from an unequally distributed decorative layer having undulations in the decoration at the connecting edges of the panels. Even if such undulations in the decoration are only a few millimeters, they are striking when viewed, which has a detrimental influence on the esthetic impression and therefore reduces the quality of the laid floor.

In order to be able to produce in suitable quality, the paper growth must be registered and the saw which saws the panels out of the substrate board must be adjusted appropriately. Manual adjustment is very time-consuming. DE 100 19 054 C1 describes a method of cutting panels to size from a substrate board with which the saw can be matched automatically to the paper growth. For this purpose, cameras are needed which determine the actual position of defined decorative points. The actual position is then compared with the intended position and the deviation of the width or length dimension is determined, so that the saw can be adjusted appropriately.

In order to optimize the cutting, it is therefore necessary to expend a great deal of effort, which makes the production of high-quality panels expensive. In order further to match the visual quality of the laminate panel to the visual quality of a natural wood panel, in the press in which the decorative layer is pressed with the substrate board, a die plate having a relief can be provided, which impresses a relief corresponding to the wood grain into the synthetic resin layer. Since the paper growth is not reproducible, it is not possible to bring the relief completely into coincidence with the decoration. The joints of a tiled surface cannot be impressed into the surface, since deviations here would immediately be visible.

Starting from this problem, a process for finishing a wooden board is to be specified with which the disadvantages described above are avoided.

SUMMARY OF THE INVENTION

The problem is solved with a wooden board by means of the following steps:

a) applying a sealing layer of melamine resin to the upper side of the board,
b) printing a decoration onto the sealing layer,
c) applying a protective layer of melamine resin to the decoration, and
d) pressing the board under the action of temperature until the protective layer and the sealing layer melt and bond to each other with the inclusion of the decoration printed on.

The board is preferably further finished by means of the following steps:

e) applying a sealing layer of melamine resin to the underside of the board,
f) applying a colored layer to the sealing layer,
g) applying a protective layer of melamine resin to the colored layer,
h) pressing the board under the action of temperature until the protective layer and the sealing layer melt and bond to each other with the inclusion of the colored layer.

In another aspect of the invention, a wooden board, in particular flooring panel, comprises an HDF or MDF substrate board with an upper side and an underside. The upper side has a decoration, wherein a sealing layer onto which a decoration is printed is applied to the substrate board. The decoration is covered by at least one wear-resistant layer.

DETAILED DESCRIPTION OF EMBODIMENTS OF THE INVENTION

Figure 1:
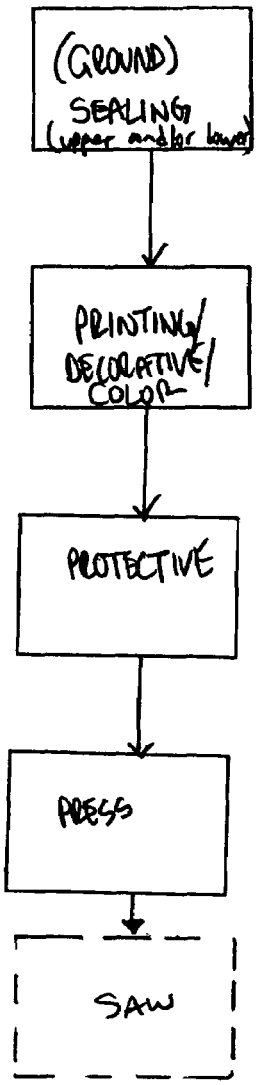
FIG. 1 shows a flow chart of the method of finishing a board in accordance with the invention.

Referring to FIG. 1, a flow chart of the method of finishing a board in accordance with the invention is shown. It should be understood that FIG. 1 is representative of the steps of the finishing process; however, FIG. 2 may equally represent some of the finishing processes as well as the resultant board or panel using the process of the invention. For example, the flow of FIG. 1 shows:

a) applying a sealing layer of melamine resin to the upper side of the board,
b) printing a decoration onto the sealing layer,
c) applying a protective layer of melamine resin to the decoration, and
d) pressing the board under the action of temperature until the protective layer and the sealing layer melt and bond to each other with the inclusion of the decoration printed thereon.

The fact that the decoration is printed onto the board means that not only are the problems associated with the paper growth avoided but also the handling associated with laying the paper web on the upper side of the board. As a result of applying the sealing layer to the substrate board, the printing ink is prevented from being absorbed by the substrate board, which would be the case without the sealing layer, since the substrate board as such is absorbent.

By means of the sealing layer, the decorative color is kept on the surface and bonded, so that the decorative layer remains on the surface and forms a precise, clearly visible decoration. The protective layer of melamine resin replaces the known overlay which, in the known finishing processes, is laid on the decorative paper. By means of the subsequent pressing under the action of temperature until the protective layer and the sealing layer melt, the decoration is enclosed and the sealing layer and protective layer become a composite. With the aid of the press plate, the level of gloss of the surface can be adjusted. If a polished press plate is used, a highly glossy surface is achieved.

The board is preferably further finished by means of the following steps, as represented in FIG. 1, for example.

(i) applying a sealing layer of melamine resin to the underside of the board, and (ii) applying a colored layer to the sealing layer.

The protective layer of melamine resin may be applied to the colored layer, and the board may be pressed under the action of temperature until the protective layer and the sealing layer melt and bond to each other with the inclusion of the colored layer.

By means of these steps, the otherwise usual undercoat in the case of a laminate panel is replaced. The individual layer thicknesses correspond to those on the upper side, so that distortion of the board is ruled out. It is particularly advantageous if the upper side and the underside are finished at the same time, which reduces the production time.

The finishing of the board can be carried out continuously, a continuous press preferably being used for the pressing. In this way, the production time is shortened further, which reduces the production costs.

The sealing layers 102 and/or the protective layers 104 are preferably applied in a plurality of individual layers, each individual layer drying out before the application of the next layer. The individual layers have a weight per unit area of 10-40 g/m$^2$ in each case. The sealing layer 102 preferably includes two individual layers; the protective layer of four individual layers. In addition, the printing ink 106 can be applied in a plurality of layers.

In order that the decoration or the colored layer 106 does not melt or experience a color change during pressing, an appropriately heat-resistant color or heat-resistant varnish 107 can be applied in accordance with the invention. The varnish layer may be electron-beam cured or UV cured.

In order to obtain a smooth surface, the board 100 is preferably ground 108 before the first individual layer of the sealing layer is applied. Corundum 110 may be mixed into or scattered into at least one individual layer of the protective layer 104 in order to increase the abrasion resistance. Antibacterial and/or antistatic additives 112 can also be mixed into or scattered onto the protective layer 104. This can be carried out in the same or in another individual layer. All the individual layers are preferably treated correspondingly.

Fillers 116 can be introduced into the sealing layer 102 and/or the protective layer 104. Suitable fillers 116 are wood fibers, wood dust, metals, mineral substances (clay, sand), plastics, cellulose or ash. The fillers 116 can achieve a structure, which is applied so as to correspond with the decoration, so that fine reliefs can be produced. In the individual layers on the underside, the fillers are used, for example, for damping the sound of footfalls.

The finishing of the upper side of the board can also be carried out only in some regions. The finishing is preferably carried out on an area of the board running obliquely with respect to the upper side. For this purpose, a number of V joints 118 can be embossed into the upper side of the board. Following finishing, the board is sawed up centrally along the V joints, so that individual panels whose side edges have a chamfer are produced. These chamfers subsequently underline the visual impression of a joint between individual panels of a floor.

Since no paper layers are used, the boards are safe against distortion which could arise as a result of the inherent tensile force of the papers. Because of the thin layers, short process times can be implemented. The fillers introduced into the individual layers on the underside of the board can be provided in order to dampen the sound of foot steps, for example.

Instead of finishing a substrate board of high or medium density fibreboard (HDF or MDF), oriented strand board (OSB boards) or conventional chipboards with a correspondingly finely distributed top layer can also be used. It is also conceivable to form the sealing layer so thickly that irregularities in the board (OSB) are compensated for. The boards can be used not only as flooring panels but can also be used in furniture construction.

Parts of the process according to the invention are suitable to impart laminate properties to a board with a real wood surface (wooden substrate board with veneer layer, solid wood), specifically high abrasion resistance, high impact resistance and an adjustable level of gloss. For this purpose, it is possible to dispense with the application of the decorative layer to the upper side or the colored layer to the underside. The subsequent sealing of the laid parquet can therefore be dispensed with. By printing on an appropriate decorative layer, inexpensive timbers can be increased in value. For example, an oak decoration can be printed onto a pine veneer and its color emphasized appropriately.

The press plate can be provided with a relief corresponding to the decoration, when the board is pressed, depressions are then produced in the protective layer, which for example correspond to a wood grain or to a tiled surface. The touch of the surface is then matched to a natural surface.

Figure 2:
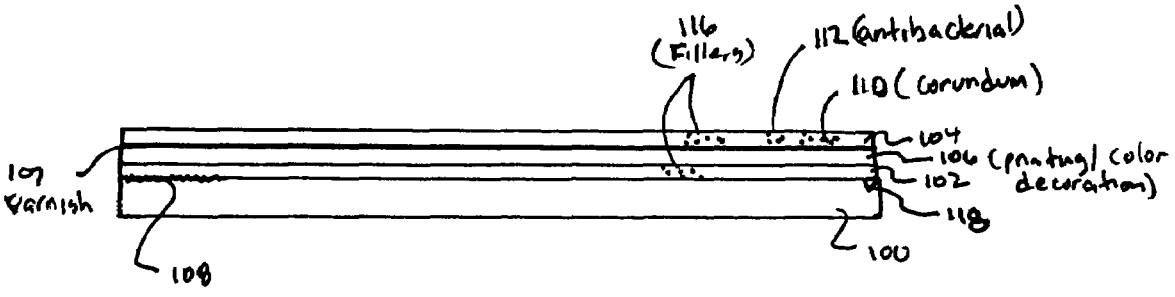
FIG. 2 shows a cross sectional view of an embodiment of the board in accordance with the invention.

In particular, V joints running in the longitudinal direction and/or transverse direction of the board can be impressed into the protective layer. During the further processing, panels are then sawed from the board by sawing being carried out centrally along the V joints. As a result, the panels are then given a chamfered edge. These features are shown in FIG. 2, which can equally represent the process of finishing the boards.

While the invention has been described in terms of embodiments, those skilled in the art will recognize that the invention can be practiced with modification within the spirit and scope of the appended claims.

The invention claimed is:

1. Process for finishing a wood or wooden board, in particular an MDF or HDF board with an upper side and an underside, comprising the following steps:

a) applying a sealing layer of melamine resin to the upper side of the board, b) printing a decoration onto the sealing layer, c) applying a protective layer of melamine resin to the decoration, and d) pressing the board under the action of temperature until the protective layer and the sealing layer melt and bond to each other with the inclusion of the decoration printed thereon.

2. The process as claimed in claim 1, further comprising the following steps:

applying a sealing layer of melamine resin to the underside of the board, applying a colored layer to the sealing layer on the underside of the board, applying a protective layer of melamine resin to the colored layer, and pressing the board under the action of temperature until the protective layer and the sealing layer melt and bond to each other with the inclusion of the colored layer.

3. The process according to claim 1, wherein the upper side and the underside are finished at the same time.

4. The process according to claim 1, wherein a plurality of individual layers are applied for at least one of the sealing layer and the protective layer and each individual layer dries out before the application of the next.

5. The process according to claim 2, wherein the board is ground before the sealing layer is applied.

6. The process according to claim 4, further comprising providing corundum into at least one individual layer of the protective layer.

7. The process according to claim 4, further comprising scattering corundum onto at least one individual layer of the protective layer.

8. The process according to claim 4, further comprising mixing at least one of antibacterial and antistatic additives into at least one individual layer of the protective layer.

9. The process according to claim 4, further comprising scattering at least one of antibacterial and antistatic additives onto at least one individual layer of the protective layer.

10. The process according to claim 1, further comprising providing at least one filler into at least one of a sealing layer and the protective layer.

11. The process according to claim 10, wherein the filler is wood fibers, wood dust, metals, mineral substances, plastics or ash.

12. The process according to claim 1, wherein finishing of the upper side of the board is carried out only in some regions.

13. The process according to claim 10, wherein finishing is carried out on an area running obliquely with respect to the upper side.

14. The process according to claim 1, wherein a structure or at least one V joint is impressed into the protective layer.

15. The process according to claim 14, further comprising sawing the board centrally along the at least one V joint to create panels each having a chamfered edge.

16. The process of claim 1, wherein the applying the sealing layer and the printing are devoid of paper layers.

17. The process of claim 1, wherein the printing a decoration onto the sealing layer prevents impregnation of the printing onto the board.

18. The process of claim 1, further comprising:

grinding the board before the applying the sealing layer, impressing a V-joint into the protective layer; and sawing the board centrally along the at least one V joint to create panels each having a chamfered edge.

19. The process of claim 1, wherein:

the board is ground before the sealing layer is applied, the sealing layer prevents printing ink from being absorbed by the board, the applying the sealing layer includes applying a first plurality of layers, each individual layer of the first plurality of layers drying out before application of a next layer, and the applying the protective layer includes applying a second plurality of layers, each individual layer of the second plurality of layers drying out before application of a next layer.

* * * * *